US006873574B1

(12) United States Patent
Gotthard

(10) Patent No.: US 6,873,574 B1
(45) Date of Patent: Mar. 29, 2005

(54) BODY JEWELRY WATCH

(76) Inventor: Scott M. Gotthard, 15 S. Baltimore Ave., Mt. Holly Springs, PA (US) 17065

( * ) Notice: Subject to any disclaimer, the term of this patent is extended or adjusted under 35 U.S.C. 154(b) by 179 days.

(21) Appl. No.: 10/364,854

(22) Filed: Feb. 10, 2003

(51) Int. Cl.[7] ..... G04B 47/00; A44C 7/00
(52) U.S. Cl. ..... 368/10; 368/279; 63/12
(58) Field of Search ..... 368/10, 276, 278–279; 63/12, 20, 21

(56) References Cited

U.S. PATENT DOCUMENTS

| | | | | | |
|---|---|---|---|---|---|
| 1,404,536 | A | * | 1/1922 | Augustinas | 368/279 |
| 2,925,706 | A | | 2/1960 | Morf | 58/59 |
| 3,998,045 | A | | 12/1976 | Lester | 58/23 R |
| 4,444,515 | A | | 4/1984 | Clark | 368/279 |
| 4,705,408 | A | | 11/1987 | Jordi | 368/278 |
| 4,821,247 | A | | 4/1989 | Grooms | 368/63 |
| RE35,511 | E | * | 5/1997 | Nakamura | 63/14.1 |
| 5,828,541 | A | | 10/1998 | Wu | 368/278 |
| 6,164,815 | A | * | 12/2000 | Degonda | 368/278 |
| 6,382,815 | B1 | | 5/2002 | Klearman et al. | 362/253 |
| 6,419,649 | B1 | | 7/2002 | Klein | 601/70 |
| 6,490,885 | B1 | | 12/2002 | Wilkinson | 63/1.11 |
| 6,527,434 | B1 | * | 3/2003 | Fox et al. | 368/276 |
| 2002/0041159 | A1 | | 4/2002 | Kaping, Jr. | 315/56 |

* cited by examiner

*Primary Examiner*—Vit W. Miska
(74) *Attorney, Agent, or Firm*—Hooker & Habib, P.C.

(57) ABSTRACT

A body jewelry watch includes a timepiece attached to mounting structure configured to mount the watch on a pierced-body part. The timepiece includes a watch mechanism housed in a watchcase. The watch mechanism has a display to measure and indicate time.

10 Claims, 2 Drawing Sheets

BODY JEWELRY WATCH

FIELD OF THE INVENTION

The invention relates to watches, and particularly to watches that function as pierced-body jewelry.

BACKGROUND OF THE INVENTION

Pierced earrings have been popular for many years. Pierced body jewelry for other parts of the body, on the other hand, are only now becoming popular in today's society. Conventional pierced body jewelry includes a piercing post that extends through a previously pierced hole in the body. Retainers are attached to the ends of the post to prevent the post from slipping out of the hole. In some types of known body jewelry one retainer includes an energizable component such as a light source or vibrator motor.

It is desirable to provide pierced body jewelry with additional features.

SUMMARY OF THE INVENTION

The invention is a body jewelry watch. The watch includes a visual or non-visual display that can be perceived by the wearer or others when the watch is worn on the pierced body part.

A watch for mounting on a pierced-body part in accordance with the present invention includes a timepiece attached to mounting structure configured to mount the watch on a pierced-body part. The timepiece includes a watch mechanism housed in a watchcase. The watch mechanism includes the display to measure and indicate time.

The mounting structure includes a piercing post configured to extend through a pierced portion of the wearer's body. A retainer is on one end of the post and the watchcase is attached to the other end of the post. The retainer and the watchcase are each sized to prevent the piercing post from slipping out of the pierced-body part. One or both of the retainer and the watchcase are removably attached to the post for inserting or removing the post from the body.

In preferred embodiments the watch display includes an analog or digital display that provides a visual message of the time. In alternative embodiments the display provides an audio or tactile message that can be perceived by the wearer or by others.

The watch movement is preferably a battery-operated quartz movement. The battery in some preferred embodiments is located within the watchcase, and can be housed in a battery compartment defined by the watch movement. In other preferred embodiments the battery is located in the retainer and circuitry extends between the battery and the movement to power the movement.

Other types of conventional watch movements, however, including mechanical movements (manual or self-winding), kinetic movements (wherein movement of a weight generates electricity), and light or solar powered movements, could be adapted for use in alternative embodiments of the invention. Thus the energy source used to drive the watch movement and the operative power connection from the energy source to the watch movement can vary in these alternative embodiments.

The pierced body jewelry of the present invention enables the wearer to wear a functional watch while at the same time displaying a novel item of body jewelry.

Other objects and features of the invention will become apparent as the description proceeds, especially when taken in conjunction with the accompanying three drawing sheets illustrating two embodiments of a body jewelry watch in accordance with the present invention.

DESCRIPTION OF THE PREFERRED EMBODIMENTS

Figure 1:
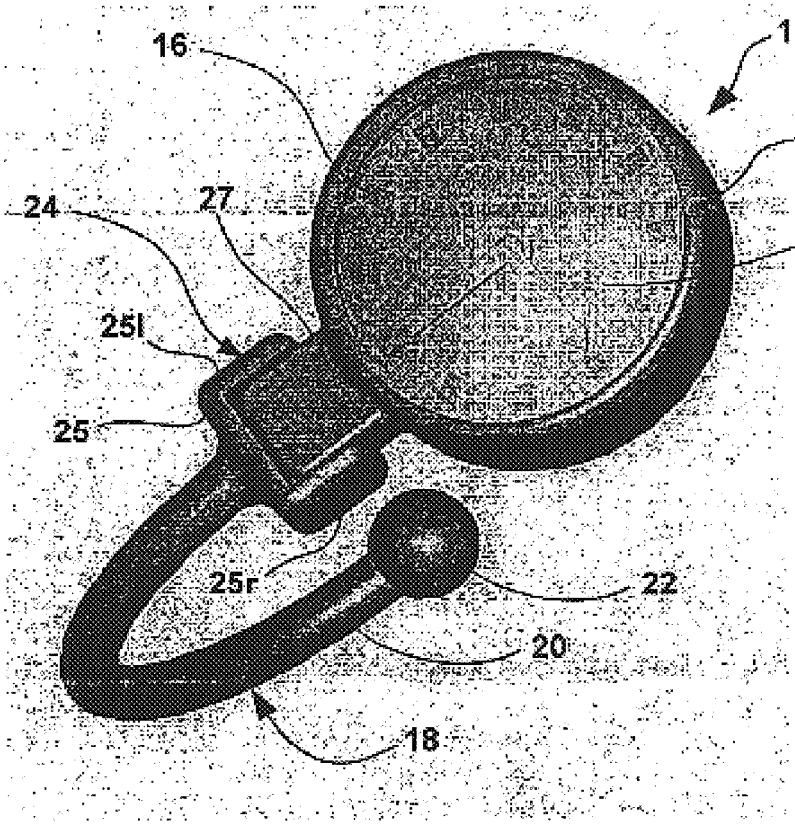
FIG. 1 is a perspective view of a body jewelry watch in accordance with the present invention, the watchcase in a first position.
Figure 2:
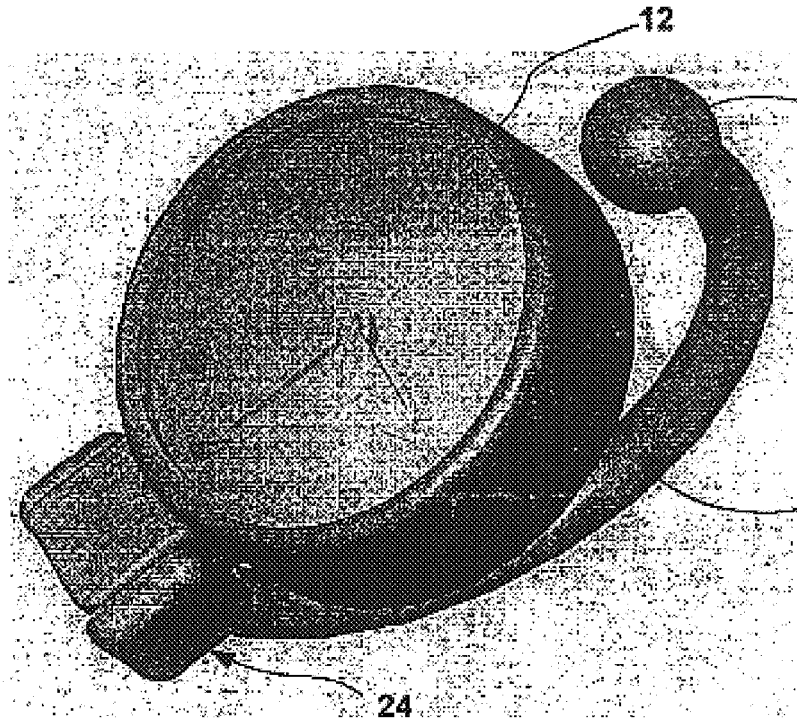
FIG. 2 is a view similar to FIG. 1 but with the watchcase in a second position.
Figure 3:
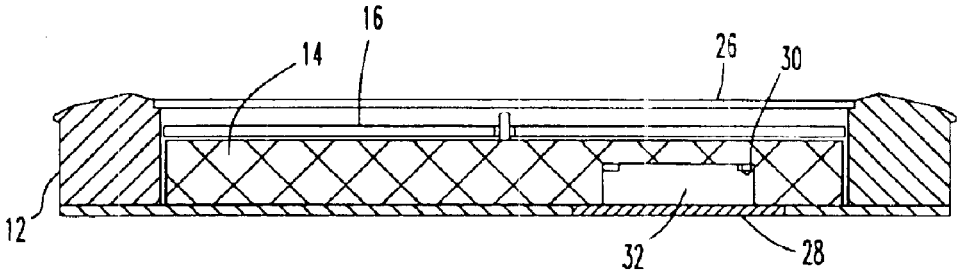
FIG. 3 is a cross-section view of the watchcase shown in FIG. 1.

FIGS. 1–3 illustrate a body jewelry watch 10 in accordance with the present invention. The watch 10 has a timepiece that includes a water-tight watchcase 12 housing a battery-operated quartz watch movement 14 for telling time. The illustrated watchcase 12 is approximately one-half inch in diameter and about a quarter-inch thick, but other embodiments can have different dimensions or can have a non-round shape. The watch movement 14 is conventional and so will not be described in detail. Watch movements sized for use in conventional petite women's watches or miniature keychain watches are particularly advantageous for the present invention because of their diminutive size and light weight.

The movement 14 drives an analog display 16 to indicate the time. The display 16 includes hour, minute and second hands located above a watch dial. The movement 14 includes a control stem (not shown) that extends outside of the watchcase for setting and otherwise controlling the watch movement, such as the setting of a day-date mechanism. In other embodiments the watch mechanism uses depressible contact pins for setting the watch movement.

The watchcase 12 is attached to mounting structure 18 that is configured to hold the watch in place by extending through a pierced portion of a wearer's body. The watchcase 12 and the mounting structure 18 are made from a biologically-compatible material such as plastic or metal.

The illustrated device 10 is configured for attachment to the navel. The mounting structure 18 includes a curved piercing post 20 and a retainer 22. The piercing post 20 is sized to extend through a hole previously pierced in the navel. The retainer 22 is threaded to one end of the post 20 in a conventional manner, and the watchcase 12 is attached to the other end of the post. The retainer 22 is sized to prevent the post from slipping out of the hole. Other types of piercing posts, including tongue posts and the like, are used in conventional pierced-body jewelry and can be adapted for attachment to the watchcase in other embodiments of the invention.

The mounting structure 18 includes a hinge structure 24 that pivotally mounts the watchcase 12 to the post. The hinge structure 24 is formed by a U-shaped yoke or fork 25 on the end of the post. The hinge 24 in effect forms an enlarged diameter post end sized to prevent the post from slipping out of the hole, and cooperates with the retainer 22 to keep the watch 10 in place in the hole despite wearer activity. Normally the fork 25 receives a watchcase mounting member 27 attached to and extending away from the watchcase.

The member 27 fits snugly between the fork arms 25*l*, 25*r*. Each side of the member 27 facing an arm includes a projection (not shown) that extends into a depression in that arm to rotatably hold the member 27 about an axis of rotation. The watchcase is movable between a first normal wearing position shown in FIG. 2 and a second viewing position shown in FIG. 1.

FIG. 3 illustrates the interior of the watchcase 12 (for clarity the watch hands are omitted). The watchcase 12 includes a transparent crystal 26 facing the watch display on one side of the case and a removable back plate 28 on the other side. Many watchcase constructions are known and can be readily adapted for use with the present invention. The watch mechanism 14 includes its own battery compartment 30 that houses a battery 32 to power the watch. The battery is replaced by removing the back plate 28 in a conventional manner.

To wear the watch 10 the wearer removes the retainer 22 and inserts the piercing post 20 through the previously pierced portion of the body. The mounting arrangement permits the watchcase to swing away from the post to facilitate insertion and later removal. The watch 10 is normally worn as shown in FIG. 2 with the watchcase 12 over the belly button and the watch dial visible to the wearer or others.

Furthermore the elasticity of the fork 25 enables the watchcase mounting member 27 to be removed from the fork even while the watch 10 is being worn. This enables the wearer to substitute differently-styled watchcases or to change a watch battery without removing the piercing post from the body. Equivalent mounting arrangements, however, are well known in the mechanical arts and can be applied in other embodiments of the watch 10. For example, the member 27 could rotate about a pin extending between the fork arms. Alternatively, the watchcase can be rigidly mounted to the mounting structure.

In other embodiments the watch 10 may be worn on a part of the body not directly visible to the wearer but visible to others. In such embodiments watch movements with an audio or tactile display may be used instead of or in addition to a visual display to inform the wearer of the time.

In yet other embodiments the watch 10 may be mounted on a part of the wearer's body (for example, the tongue) wherein the watch display cannot be readily seen by the wearer. In such embodiments the watch display may be configured for viewing in a mirror. The wearer uses the mirror to view a reflection of the watch display instead of viewing the watch display directly.

Figure 4:
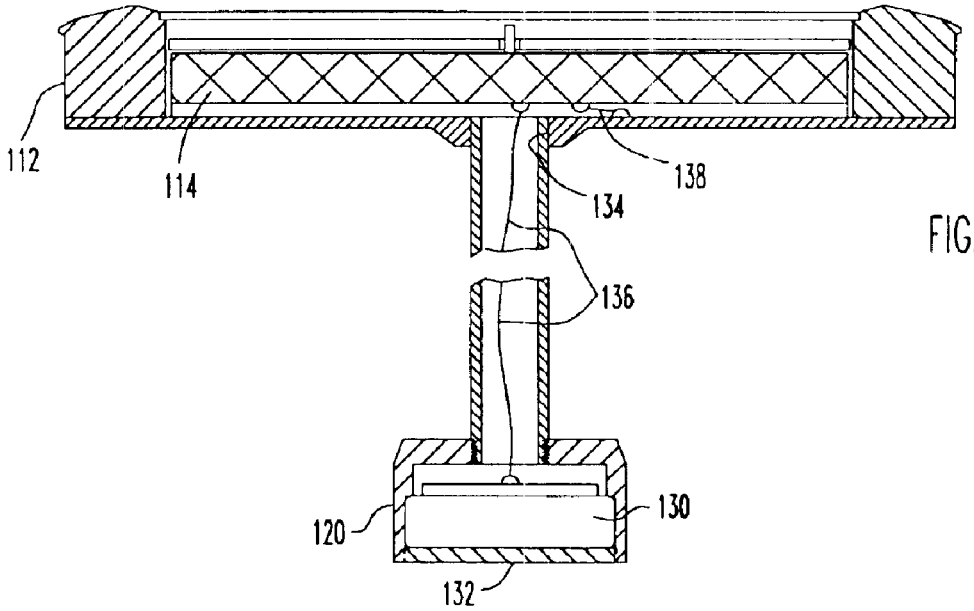
FIG. 4 is a cross-section view of a second embodiment body jewelry watch in accordance with the present invention.

FIG. 4 illustrates a second embodiment body jewelry watch 110 that includes a watch movement 114, similar to the watch movement 14, in the watchcase 112. Unlike the device 10, the watch battery 130 is housed in the retainer 120 and not the watchcase. Removing the battery from the watchcase may enable use of a thinner or slimmer watchcase.

The retainer 120 defines a battery compartment and includes a threaded, removable battery cap 132. In this embodiment the piercing post 118 is similar to the post 18 but is a uniform-diameter hollow tube. The watchcase 112 serves as a retainer on its end of the post 118. The mounting structure includes a hole 134 in the watchcase 112 that receives an end portion of the post 118. The battery 130 is connected to the watch movement by a negative power lead wire 136 fed through the interior of the post. A positive lead wire 138 extends from the watch movement and is attached to the inner surface of the watchcase 112. The illustrated circuitry is simplified for clarity; circuitry connecting a power source in one retainer to an energizable device in another retainer of pierced body jewelry is known and disclosed in Klearman et al., U.S. Pat. No. 6,382,815, Klien, U.S. Pat. No. 6,419,649, and Wilkinsen, U.S. Pat. No. 6,490,885, each of which are incorporated by reference as if fully set forth herein.

In yet other embodiments of the body jewelry watch, the battery or other power source is outside of the timepiece or mounting structure. Circuitry extends from the power source and into the watchcase to the power the watch movement.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A body jewelry watch comprising:

a timepiece and mounting structure attached to the timepiece, the mounting structure configured for mounting the watch on a pierced-body part;

the timepiece comprising a watchcase, a watch movement in the watchcase, a power source, and a mechanical or electrical power connection extending from the power source and the watch movement to power the watch movement;

the mounting structure comprising a piercing post having opposite end portions, the post configured to extend through a pierced portion of the wearer's body, a retainer on one end portion of the post and the watchcase attached to the other end portion of the post, the retainer sized to prevent the piercing post from slipping out of the pierced-body part, the mounting structure removably mounting the retainer or the watchcase to the post to enable inserting or removing the post from the body;

and the watch mechanism comprising a display to indicate the time, the display being sensible to the wearer or to others when the watch is worn on the pierced body part.

2. The watch of claim 1 wherein the mounting structure is configured to mount the watch to one of: a tongue, a lip and a navel.

3. The watch of claim 2 wherein the post is curved.

4. The watch of claim 2 wherein the post is straight.

5. The watch of claim 2 wherein the mounting structure comprises a hinge pivotally mounting the watchcase to the post end portion.

6. The watch of claim 5 wherein the piercing post has a first width dimension and the hinge has a second width dimension greater than the first width dimension whereby the hinge is sized to prevent the piercing post from slipping out of the pierced-body part.

7. The watch of claim 1 wherein the piercing post has a first width dimension and the watchcase has a second width dimension greater than the first width dimension whereby the watchcase is sized to prevent the piercing post from slipping out of the pierced-body part.

8. The watch of claim 1 wherein the power supply comprises a battery.

9. The watch of claim 8 wherein the battery is within the watchcase during normal operation of the watch.

10. The watch of claim 8 wherein the battery is within the retainer.

* * * * *